US009491540B2

(12) United States Patent
Akino

(10) Patent No.: US 9,491,540 B2
(45) Date of Patent: Nov. 8, 2016

(54) ELECTRET CONDENSER MICROPHONE

(71) Applicant: Hiroshi Akino, Tokyo (JP)

(72) Inventor: Hiroshi Akino, Tokyo (JP)

(73) Assignee: Kabushiki Kaisha Audio-Technica, Tokyo (JP)

( * ) Notice: Subject to any disclaimer, the term of this patent is extended or adjusted under 35 U.S.C. 154(b) by 0 days.

(21) Appl. No.: 14/503,679

(22) Filed: Oct. 1, 2014

(65) Prior Publication Data

US 2015/0104056 A1 Apr. 16, 2015

(30) Foreign Application Priority Data

Oct. 11, 2013 (JP) ..... 2013-213442

(51) Int. Cl.
*H04R 3/00* (2006.01)
*H04R 19/01* (2006.01)

(52) U.S. Cl.
CPC ..... *H04R 3/00* (2013.01); *H04R 19/016* (2013.01)

(58) Field of Classification Search
CPC ..... H04R 19/005; H04R 19/04; H04R 5/04
USPC ..... 381/369, 28
See application file for complete search history.

(56) References Cited

U.S. PATENT DOCUMENTS 5,677,959 A * 10/1997 Silfvast ..... H04B 3/00 333/25
7,702,118 B2 * 4/2010 Park ..... H04R 3/007 381/111
2006/0251274 A1 * 11/2006 Akino ..... H04R 1/04 381/111
2012/0114146 A1 * 5/2012 Shimura ..... H04R 19/016 381/174

FOREIGN PATENT DOCUMENTS

JP 2012175129 A 9/2012

* cited by examiner

*Primary Examiner* — Rasha Al Aubaidi
(74) *Attorney, Agent, or Firm* — Whitham, Curtis & Cook, P.C.

(57) ABSTRACT

The electret condenser microphone according to the present invention includes an electret condenser microphone unit including a diaphragm and a fixed pole disposed opposite to the diaphragm; and a three-pin plug including a hot terminal and a cold terminal and being capable of producing a balanced output, wherein each of the hot terminal and the cold terminal is coupled to an FET that functions as an impedance converter a gate terminal of one of the FETs is coupled to the diaphragm, a gate terminal of the other of the FETs is coupled to the fixed pole, and the gate terminal of the FET coupled to the cold terminal is AC-grounded.

7 Claims, 3 Drawing Sheets

ELECTRET CONDENSER MICROPHONE

TECHNICAL FIELD

The present invention relates to an electret condenser microphone.

BACKGROUND ART

An electret condenser microphone unit included in an electret condenser microphone has a high output impedance. Accordingly, an impedance converter mainly composed of FETs is disposed between the condenser microphone unit and its output terminal.

The impedance converter is coupled to, for example, a fixed pole side of the electret condenser microphone unit. In this case, a diaphragm that is oppositely disposed with a gap to the fixed pole is grounded. An operation power source fed to such an electret condenser microphone generates a potential difference between the diaphragm and the fixed pole. In the electret condenser microphone, an electret layer then generates an equivalent polarization voltage between the diaphragm and the fixed pole. The potential difference between the diaphragm and the fixed pole adversely affects the equivalent polarization voltage.

For example, if the potential difference between the diaphragm and the fixed pole increases the surface potential of the electret layer, the electrostatic attractive force increases between the diaphragm and the fixed pole. If the electrostatic attractive force between the diaphragm and the fixed pole is too large, the diaphragm is pulled to and contacts the fixed pole, which causes the diaphragm not to vibrate and thus to preclude the function as a microphone. That is, an electric potential that increases the surface potential of the electret layer leads to a failure of the electret condenser microphone unit.

Conversely, if the potential difference between the diaphragm and the fixed pole decreases the surface potential of the electret layer, while the diaphragm does not contact the fixed pole, the electric signal output from the fixed pole side in response to the vibration of the diaphragm is low. That is, the sensitivity of the electret condenser microphone unit is reduced. In order to prevent such a failure and a reduction in the sensitivity, no potential difference should not be generated between the diaphragm and the fixed pole included in the electret condenser microphone even under a condition in which the operation power source is fed.

A phantom power source is known as an operating power source for the electret condenser microphone. The phantom power source supplies the electret condenser microphone with, for example, 48-V power via a supply resistor. The electret condenser microphone having the phantom power supply includes a three-pin connector. One of the three pins is a ground terminal. The other two pins, called a hot terminal and a cold terminal, are output terminals from which sound signals are balance output.

FIGS. 2 and 3 are circuit diagrams showing a typical conventional electret condenser microphone. The voltage added to gate terminals of FETs included in an impedance converter 200 of the electret condenser microphone shown in FIGS. 2 and 3 is half of the voltage fed from a secondary center tap of an output transformer 300. Assuming that the current consumption of the microphone is 3 mA for a voltage of 48V from the phantom power supply, the potentials of a PIN 2 (a hot terminal) and a PIN 3 (a cold terminal) are about 38 V. The potentials of the gate terminals of the FETs included in the impedance converter 200 are about 19 V.

Assuming that the equivalent polarization voltage between the diaphragm and the fixed pole included in the electret condenser microphone unit 100 is −20 V, the potential (19 V) of the gate terminal of the FET and the equivalent polarization voltage are cancelled. This reduces the equivalent polarization voltage in the electret condenser microphone unit 100 to substantially about 1 V, in other words, reduces the sensitivity of the electret condenser microphone unit 100.

A conventional method for solving the above-mentioned problems includes a bridge circuit 400 as shown in FIG. 2. The bridge circuit 400 includes four resistors, i.e., a first resistor 401, a second resistor 402, a third resistor 403, and a fourth resistor 404. The diaphragm side of the electret condenser microphone unit 100 is coupled to a node between the first resistor 401 and the second resistor 402. The output side of the impedance converter 200 is coupled to a node between the third resistor 403 and the fourth resistor 404. The bridge circuit 400 in such a circuit configuration can eliminate the potential difference between the diaphragm and the fixed pole in the electret condenser microphone unit 100. The elimination of the potential difference between the diaphragm and the fixed pole in the electret condenser microphone unit 100 can prevent a failure and a reduction in the sensitivity of the electret condenser microphone unit 100.

As shown in FIG. 3, two capacitors 201 disposed between a fixed pole of an electret condenser microphone unit 100 and an impedance converter 200 enables the DC potential to be zero in the fixed pole of the electret condenser microphone unit 100. Since the diaphragm side is grounded, the potential difference between the fixed pole and a diaphragm can be eliminated, and thereby preventing an adverse effect on the equivalent polarization voltage.

While the electret condenser microphones shown in FIGS. 2 and 3 each include an output transformer 300 in the output circuit, an electret condenser microphone without the output transformer 300 in the output circuit is also known. An output circuit with no transformer includes an emitter follower circuit as the output circuit of the electret condenser microphone (refer to PTL 1, Japanese Unexamined Patent Application Publication No. 2012-175129).

Like the electret condenser microphone shown in PTL 1, the electret condenser microphone with a transformerless output circuit has a simple circuit configuration. In an electret condenser microphone with a transformerless output circuit, the potential between a hot terminal and a cold terminal that are output terminals and the potential at a gate terminal of an FET included in an impedance converter are very close. If the consumption current is 3 mA for 48 V fed to the electret condenser microphone by phantom power feeding, the potential between the hot terminal and the cold terminal is about 38 V. In this case, the potential at the gate terminal of the FET included in the impedance converter is about 37 V.

Assuming that the equivalent polarization voltage between the diaphragm and the fixed pole is −20 V, the polarity of the potential (37 V) at the gate terminal and that of the equivalent polarization voltage is inverted, thereby causing the contact of the diaphragm to the fixed pole. If a transformerless output circuit is used, the potential difference between the diaphragm and the fixed pole is high, thereby reducing the sensitivity of the microphone.

In an electret condenser microphone, a potential difference between a diaphragm and a fixed pole by an operating power source causes a failure and a reduction in the sensitivity regardless whether a transformer is included in an output circuit or not. The potential difference between the diaphragm and the fixed pole in the electret condenser microphone including a transformerless output circuit can be zero in the configuration shown in FIGS. 2 and 3. However, the circuit configurations shown in FIGS. 2 and 3 are complicated. It is therefore desirable to reduce the potential difference between the diaphragm and the fixed pole to zero without a complicated circuit configuration.

SUMMARY OF THE INVENTION

An object of the present invention is to provide an electret condenser microphone that can prevent contact of a diaphragm to a fixed pole and can prevent a reduction in the sensitivity regardless whether an operation power source is provided or not.

The electret condenser microphone according to the present invention includes: an electret condenser microphone unit including a diaphragm and a fixed pole disposed opposite to the diaphragm; and a three-pin plug including a hot terminal and a cold terminal and being capable of producing a balanced output, wherein each of the hot terminal and the cold terminal is coupled to an FET functioning as an impedance converter, a gate terminal of one of the FETs is coupled to the diaphragm, a gate terminal of the other of the FETs is coupled to the fixed pole, and the gate terminal of the FET coupled to the cold terminal is AC-grounded.

The present invention can prevent contact of a diaphragm to a fixed pole and can prevent a reduction in the sensitivity regardless whether an operation power source is provided or not.

DESCRIPTION OF EMBODIMENTS

Figure 1:
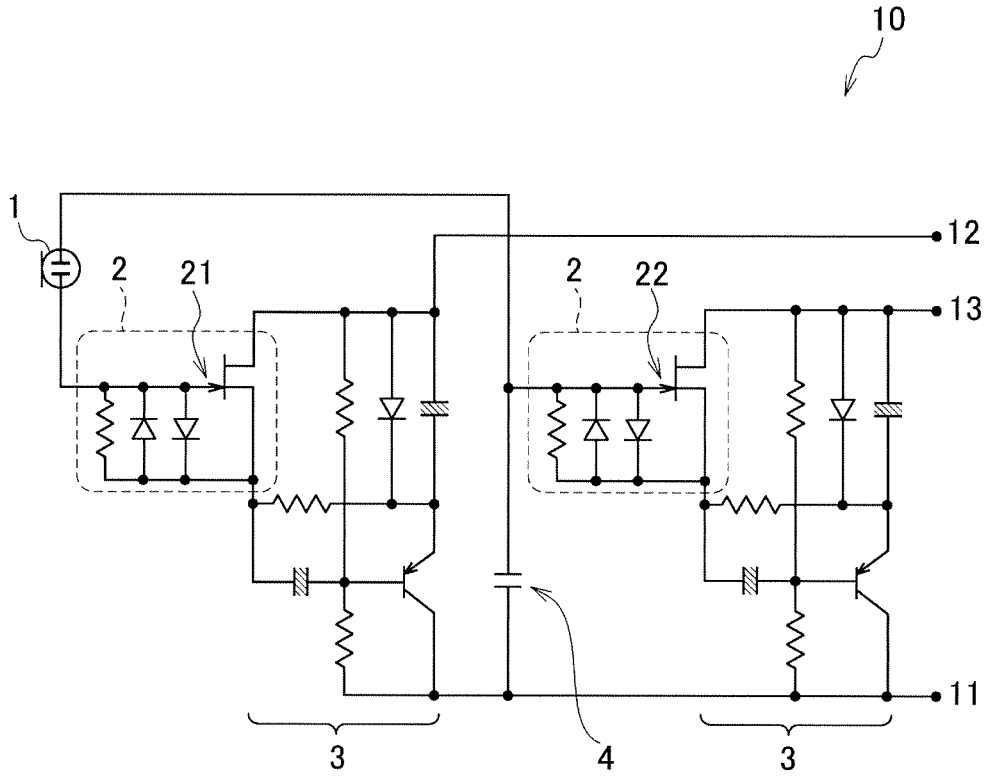
FIG. 1 is a circuit diagram illustrating an embodiment of an electret condenser microphone according to the present invention.
Figure 2:
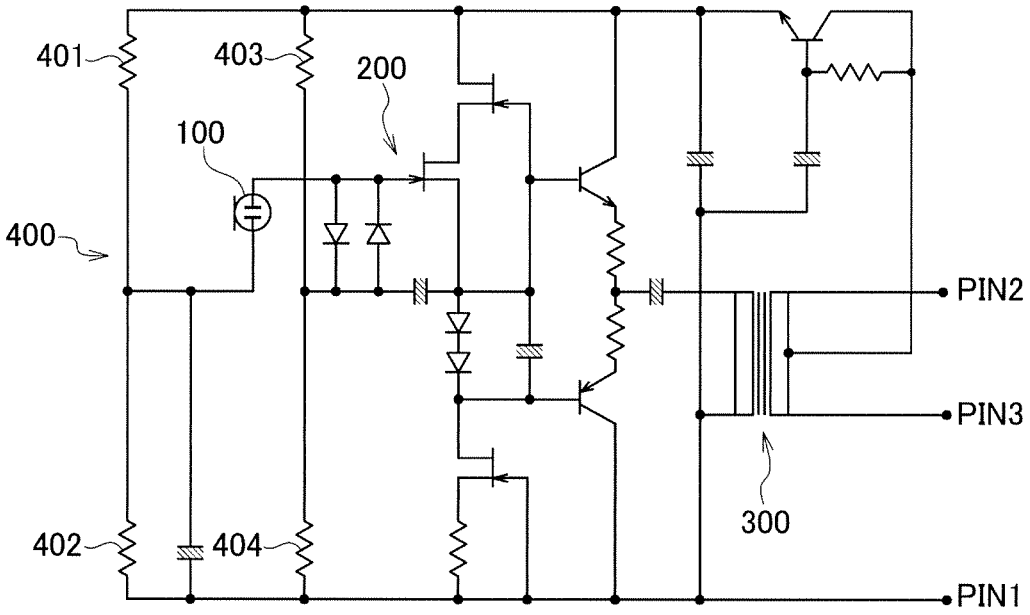
FIG. 2 RELATED ART
FIG. 2 is a circuit diagram illustrating an example conventional electret condenser microphone.
Figure 3:
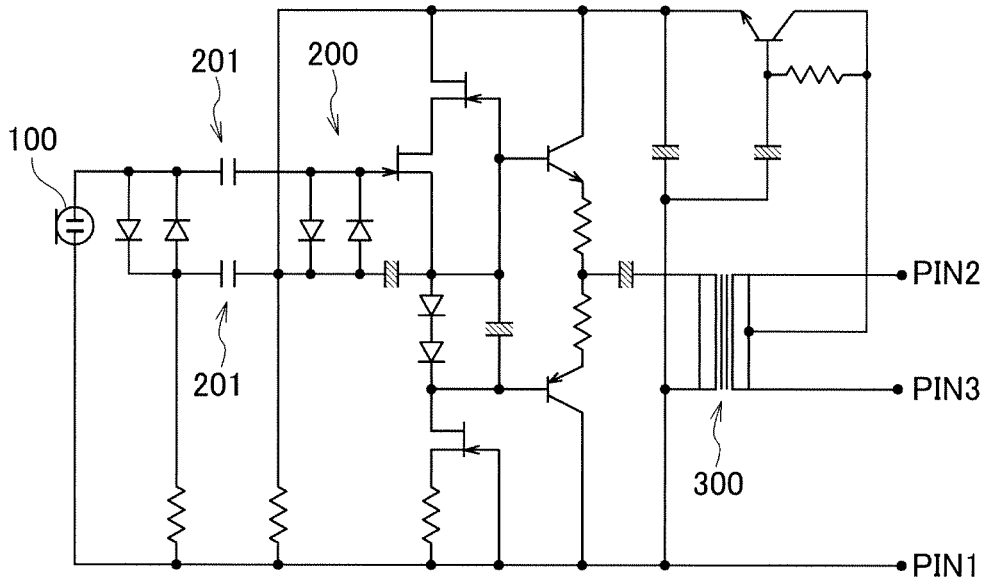
FIG. 3 RELATED ART
FIG. 3 is a circuit diagram illustrating another example conventional electret condenser microphone.

Embodiments of an electret condenser microphone according to the present invention will now be described with reference to the accompanying drawings. FIG. 1 is a circuit diagram illustrating an embodiment of the electret condenser microphone according to the present invention. In FIG. 1, a microphone 10 comprises an electret condenser microphone unit (hereinafter, referred to as a "microphone unit") 1.

The microphone unit 1 comprises a diaphragm and a fixed pole disposed opposite to the diaphragm.

An operating power source of the microphone 10 is a phantom power source. An output terminal of the microphone 10 is a three-pin plug including a hot terminal 12, a cold terminal 13 and a ground terminal 11. The output of the microphone 10 is a balanced output that is output from the hot terminal 12 and the cold terminal 13.

The output of the microphone 10 is a balanced output and each of the fixed pole and the diaphragm of the microphone unit 1 is coupled to respective impedance converters 2. In addition, an output circuit of the microphone 10 includes no transformer. Therefore, buffer amplifiers 3 (emitter follower circuits) as transformerless output circuits are coupled to rear stages of the respective impedance converters 2. That is, the microphone 10 includes two impedance converters 2, 2 and two buffer amplifiers 3, 3.

A gate terminal 22 of an FET included in the impedance converter 2 coupled to the diaphragm side of the microphone unit 1 is AC-grounded to a ground terminal 11 via a capacitor 4.

Output terminals coupled to both ends (the diaphragm and the fixed pole) of the microphone unit 1 have the same circuit configuration. Since the microphone 10 has a balanced output, the operating power of the same voltage is fed from the phantom power source to both the hot terminal 12 and the cold terminal 13. The fed operating power causes the same voltage drop to occur in circuits coupled to the both ends of the microphone unit 1. As a result, the potential at the gate terminal 21 of the FET included in one impedance converter 2 coupled to the fixed pole is equal to the potential at the gate terminal 22 of the FET included in the other impedance converter 2 coupled to the diaphragm.

The potential at the diaphragm is equal to the potential at the fixed pole of the microphone unit 1. Thus, the microphone 10 does not generate any potential difference between the diaphragm and the fixed pole that may adversely affect the equivalent polarization potential of the microphone unit 1. In addition, the potential difference between the diaphragm and the fixed pole can be zero.

The microphone 10 including the above-mentioned transformerless output circuit can prevent the contact of the diaphragm included in the microphone unit 1 to the fixed pole. In addition, in the microphone 10 including the above-mentioned transformerless output circuit, the equivalent polarization potential does not decrease, and thus its sensitivity is not reduced.

That is, the microphone 10 having a simple circuit configuration does not cause a potential difference between the fixed pole and the diaphragm of the microphone unit 1, without a contact of the diaphragm to the fixed pole, and thus without a reduction in sensitivity.

The invention claimed is:

1. An electret condenser microphone comprising:

a single electret condenser microphone unit including
- a diaphragm and
- a fixed pole disposed opposite to the diaphragm; and a three-pin plug including a hot terminal, a cold terminal, and a ground terminal, and being capable of producing a balanced output from the hot terminal and the cold terminal, wherein the hot terminal is coupled to a first field effect transistor (FET) and the cold terminal is coupled to a second FET, and each of said first and second FETs function as an impedance converter, a gate terminal of one of the first and second FETs is coupled to the diaphragm of the single electret condenser microphone unit, a gate terminal of the other of the first and second FETs is coupled to the fixed pole of the single electret condenser microphone unit, and the gate terminal of the FET coupled to the cold terminal is AC-grounded and is coupled to the ground terminal.

2. The electret condenser microphone according to claim 1, wherein an output circuit disposed between the impedance converter and the output terminal is a transformerless output circuit.

3. The electret condenser microphone according to claim 2, wherein the output circuit coupled to the hot terminal and the output circuit coupled to the cold terminal have the same circuit configuration.

4. The electret condenser microphone according to claim 2, wherein the potential at the gate terminal of the FET coupled to the hot terminal is equal to the potential at the gate terminal of the FET coupled to the cold terminal.

5. The electret condenser microphone according to claim 1, wherein an output circuit coupled to the hot terminal and an output circuit coupled to the cold terminal have the same circuit configuration.

6. The electret condenser microphone according to claim 1, wherein a potential at the gate terminal of the FET coupled to the hot terminal is equal to a potential at the gate terminal of the FET coupled to the cold terminal.

7. The electret condenser microphone according to claim 1, wherein the gate terminal of the FET that is AC-grounded is coupled to the ground terminal via a capacitor.

* * * * *